US010930106B2

(12) United States Patent
Nakashima et al.

(10) Patent No.: US 10,930,106 B2
(45) Date of Patent: Feb. 23, 2021

(54) COIN PLACEMENT UNIT FOR CASH PROCESSING MACHINE AND SELF-CHECKOUT DEVICE INCLUDING THE SAME

(71) Applicant: NEC Platforms, Ltd., Kawasaki (JP)

(72) Inventors: Takashi Nakashima, Kanagawa (JP); Natsuki Hagiwara, Kanagawa (JP)

(73) Assignee: NEC Platforms, Ltd., Kawasaki (JP)

( * ) Notice: Subject to any disclaimer, the term of this patent is extended or adjusted under 35 U.S.C. 154(b) by 0 days.

(21) Appl. No.: 16/485,313

(22) PCT Filed: Feb. 21, 2018

(86) PCT No.: PCT/JP2018/006190
§ 371 (c)(1),
(2) Date: Aug. 12, 2019

(87) PCT Pub. No.: WO2018/159408
PCT Pub. Date: Sep. 7, 2018

(65) Prior Publication Data

US 2020/0058183 A1 Feb. 20, 2020

(30) Foreign Application Priority Data

Mar. 2, 2017 (JP) ..... JP2017-039145
Feb. 14, 2018 (JP) ..... JP2018-024008

(51) Int. Cl.
*G07D 11/00* (2019.01)
*G07G 1/12* (2006.01)
*G07G 1/00* (2006.01)

(52) U.S. Cl.
CPC ..... *G07D 11/009* (2013.01); *G07G 1/0018* (2013.01); *G07G 1/12* (2013.01)

(58) Field of Classification Search
CPC ..... G07D 11/009
(Continued)

(56) References Cited

U.S. PATENT DOCUMENTS 4,867,506 A * 9/1989 Chavez ..... A61G 5/10 297/188.2
5,842,916 A 12/1998 Gerrity et al.
(Continued)

FOREIGN PATENT DOCUMENTS

CN 1212778 A 3/1999
CN 101226656 A 7/2008
(Continued)

OTHER PUBLICATIONS

Communication dated Feb. 26, 2020, issued by the Japan Patent Office in application No. 2019-080857.
(Continued)

*Primary Examiner* — Allyson N Trail
(74) *Attorney, Agent, or Firm* — Sughrue Mion, PLLC

(57) ABSTRACT

A coin placement unit is equipped with: a coin spread portion having two perpendicular wall surfaces and a recessed surface comprising a gutter-shaped recessed portion extending in the direction orthogonal to the perpendicular wall surfaces between the two perpendicular wall surfaces; a coin slot portion having a coin slot; and a ridge line portion provided between the coin spread portion and the coin slot portion so as to partition the coin spread portion and the coin slot portion. The coin spread portion, the ridge line portion, and the coin slot portion have the same width and are continuous in the direction toward a depth side.

8 Claims, 6 Drawing Sheets

(a)

(b)

(58) Field of Classification Search
USPC ..... 235/379
See application file for complete search history.

(56) References Cited

U.S. PATENT DOCUMENTS

| | | | | |
|---|---|---|---|---|
| 2005/0145463 | A1* | 7/2005 | Gerrity | G07D 9/00 194/302 |
| 2008/0090509 | A1* | 4/2008 | Enomoto | G07D 9/008 453/57 |
| 2011/0057036 | A1* | 3/2011 | Matsuhisa | G07F 5/24 235/383 |
| 2015/0122754 | A1* | 5/2015 | Jung | G07G 1/0027 211/49.1 |
| 2017/0221292 | A1 | 8/2017 | Watanabe et al. | |
| 2018/0137490 | A1* | 5/2018 | Yasui | G06Q 20/18 |
| 2019/0244472 | A1* | 8/2019 | Efremescu | G07F 17/3239 |

FOREIGN PATENT DOCUMENTS

| | | | |
|---|---|---|---|
| JP | 48-40797 | Y | 11/1973 |
| JP | 6-348957 | A | 12/1994 |
| JP | 7-16268 | U | 3/1995 |
| JP | 2008-130009 | A | 6/2008 |
| JP | 2008-217737 | A | 9/2008 |
| JP | 2012-8810 | A | 1/2012 |
| JP | 2012-93909 | A | 5/2012 |
| JP | 6026694 | B1 | 11/2016 |
| JP | 6088691 | B1 | 3/2017 |
| WO | 98/00813 | A2 | 1/1998 |

OTHER PUBLICATIONS

International Search Report for PCT/JP2018/006190 dated May 29, 2018 (PCT/ISA/210).
Written Opinion of the International Searching Authority for PCT/JP2018/006190 dated May 29, 2018 (PCT/ISA/237).
Japanese Office Action for 2018-024008 dated May 10, 2018.
Communication dated Dec. 17, 2020 from the Intellectual Property Office of India in Application No. 201917031798.
Chinese Office Action for CN Application No. 201880015076.8 dated Dec. 16, 2020 with English Translation.

* cited by examiner (b)

(a)

COIN PLACEMENT UNIT FOR CASH PROCESSING MACHINE AND SELF-CHECKOUT DEVICE INCLUDING THE SAME

CROSS REFERENCE TO RELATED APPLICATIONS

This application is a National Stage of International Application No. PCT/JP2018/006190 filed Feb. 21, 2018, claiming priority based on Japanese Patent Application No. JP 2017-039145, filed Mar. 2, 2017 and Japanese Patent Application No. JP-2018-024008 filed Feb. 14, 2018, the disclosures of which are incorporated herein in their entirety by reference.

TECHNICAL FIELD

The present invention relates to a coin placement unit for a cash processing machine, and to a self-checkout device including the same.

BACKGROUND

As one example of a Point-of-Sales (POS) system installed in a store such as a supermarket, there has been known the following mode. The POS system comprises a POS terminal device and a self-checkout device. A clerk uses the POS terminal device to perform product registration of a product which is to be purchased by a customer. The customer uses the self-checkout device to perform checkout after completion of the product registration. The self-checkout device includes a banknote slot and a coin slot. When the customer performs checkout with cash through the self-checkout device, banknotes are introduced into the banknote slot and coins are introduced into the coin slot.

In self-checkout, at the time of introducing coins into the coin slot, some customers take out coins from a wallet more than necessary, spread the coins on a coin placement unit, select desired coins among the spread coins, introduce the selected coins into the coin slot, and return remaining coins from the coin placement unit into the wallet.

Facilitation of an action of returning the remaining coins from the coin placement unit into the wallet leads to improvement in service for such customers in terms of ease of checkout and shortened checkout time. Moreover, the shortened checkout time leads to improvement in service in terms of shortened waiting time of a next customer who is waiting for checkout.

PRIOR ART DOCUMENT

Patent Document

Patent Document 1: JP 6026694 B

SUMMARY OF THE INVENTION

Problem to be Solved by the Invention

Incidentally, as a system similar to the POS system described above, in Patent Document 1, there is disclosed a settlement device which is applied to a settlement process performed by a customer after product registration by the customer (clerk in some cases). The settlement device also includes a cash (especially coins) placement unit, and the customer can take out coins from a wallet, spread the coins on the cash placement unit, and introduce desired coins into a coin slot.

However, with regard to the settlement device, no consideration is made on facilitation of an action of taking out remaining coins from the cash placement unit and returning the coins into the wallet after completion of the settlement.

Therefore, an object of the present invention is to provide a coin placement unit which enables a user, at the time of self-checkout, to easily introduce desired coins into a coin slot and take out remaining coins.

Further, the present invention is to provide a self-checkout device including the coin placement unit described above.

Means to Solve the Problem

According to one aspect of the present invention, there is provided a coin placement unit for a cash processing machine, comprising: a coin spread portion including two perpendicular wall surfaces and a recessed surface, which is formed between the two wall surfaces, and is formed of a gutter-shaped recessed portion extending in a direction orthogonal to the wall surfaces; a coin slot portion including a coin slot; and a ridge line portion formed between the coin spread portion and the coin slot portion so as to partition the coin spread portion and the coin slot portion, wherein the coin spread portion, the ridge line portion, and the coin slot portion have the same width and are continuous in a direction toward a depth side.

Effect of the Invention

According to the present invention, it is possible to provide a coin placement unit which enables a user to easily introduce desired coins into a coin slot and take out remaining coins and to provide a self-checkout device including the coin placement unit.

MODE FOR EMBODYING THE INVENTION

An embodiment of the present invention is described with reference to FIG. 1 to FIG. 7.

Figure 1:
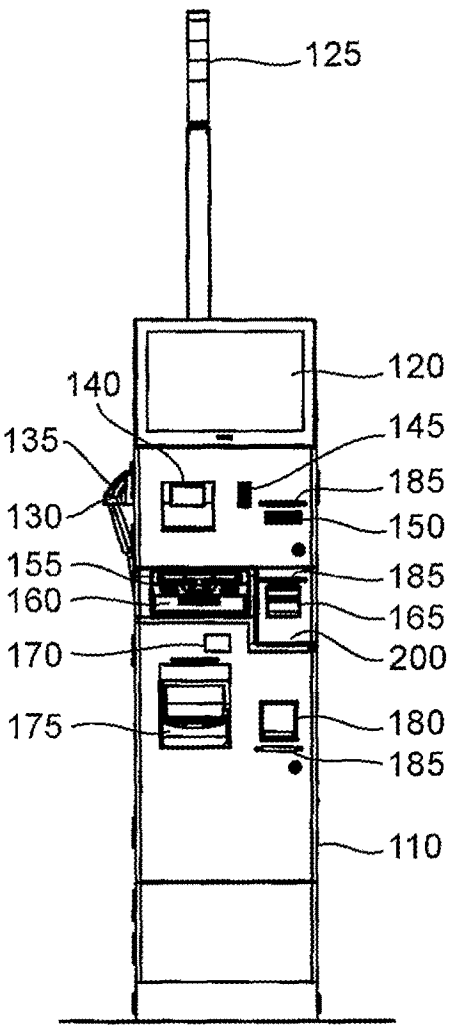
FIG. 1 includes (*a*) and (*b*) which are a perspective view and a front view of a self-checkout device according to an embodiment of the present invention, respectively.
Figure 1:
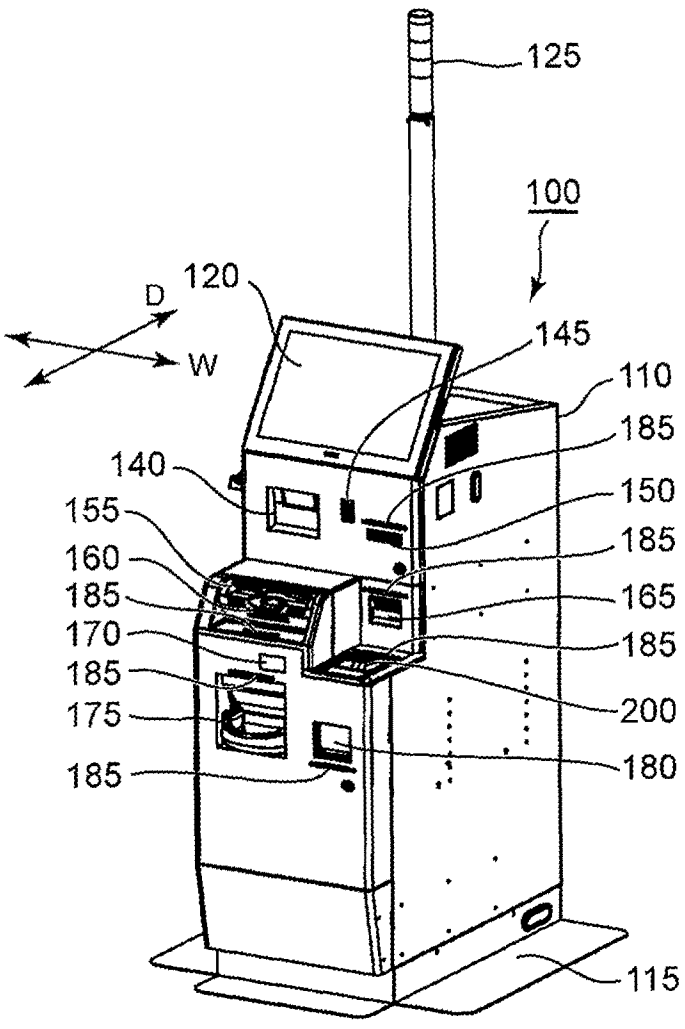
Figure 2:
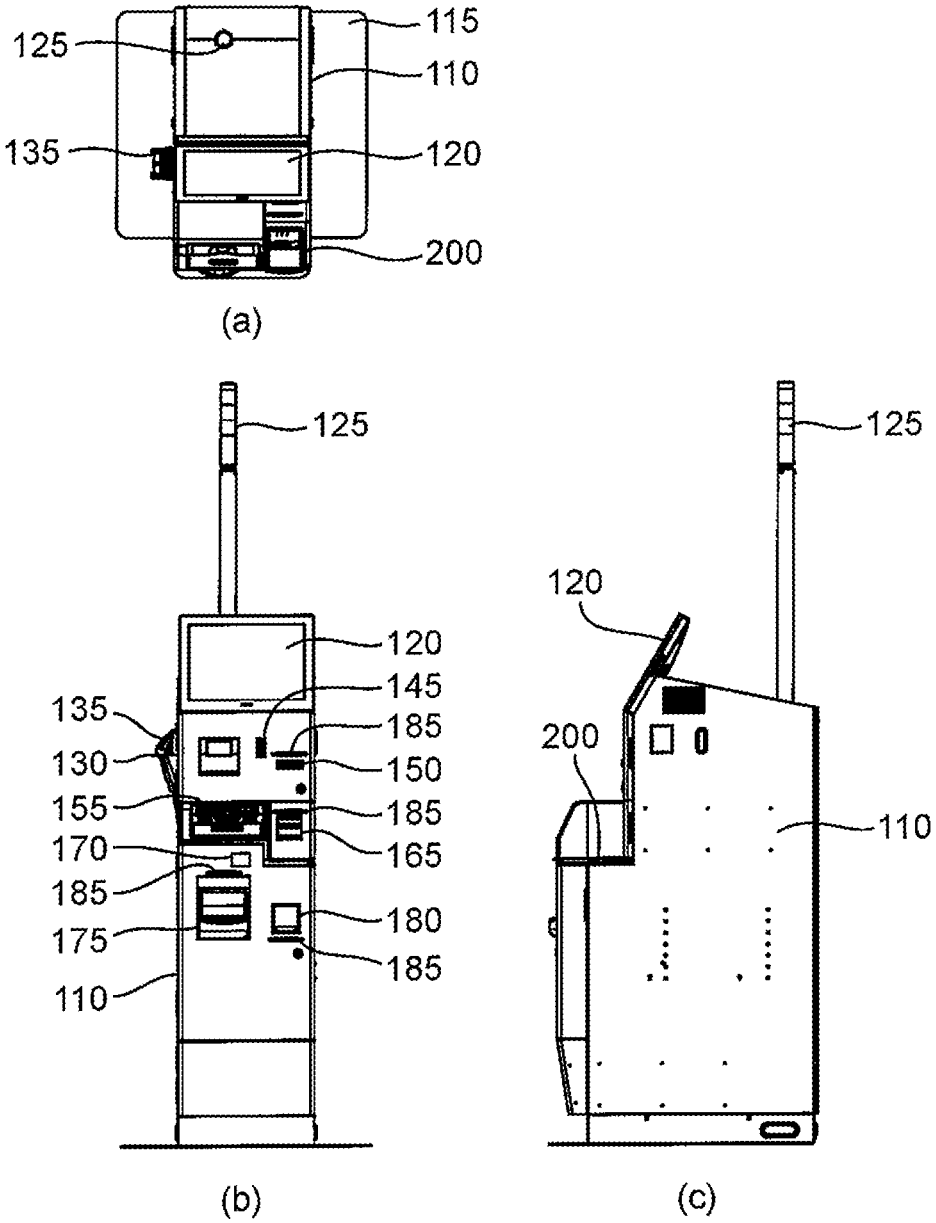
FIG. 2 includes (*a*), (*b*), and (*c*) which are a top view, a front view, and a right side view of the self-checkout device of FIG. 1, respectively.
Figure 3:
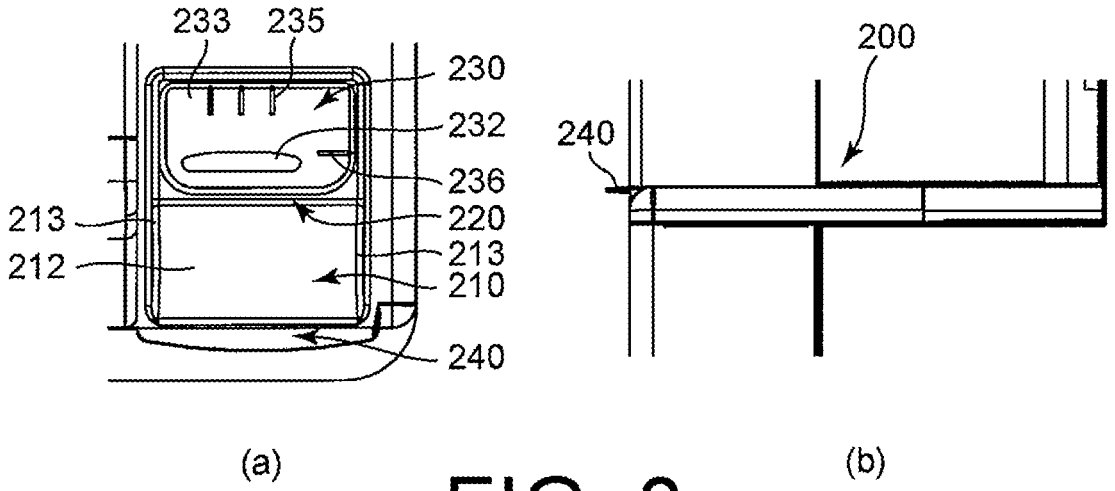
FIG. 3 includes (*a*) which is an enlarged view of a coin placement unit in the top view of FIG. 2 (*a*) and (*b*) which is an enlarged view of the coin placement unit in the right side view of FIG. 2 (*c*).

FIG. 1 (*a*) and FIG. 1 (*b*) are a perspective view and a front view of a self-checkout device according to an embodiment of the present invention. FIG. 2 (*a*), FIG. 2 (*b*), and FIG. 2 (*c*) are a top view, a front view, and a right side view of the self-checkout device of FIG. 1, respectively. FIG. 3 (*a*) is an enlarged view of a coin placement unit in the top view of FIG. 2 (*a*). FIG. 3 (*b*) is an enlarged view of the coin placement unit in the right side view of FIG. 2 (*c*). The self-checkout device described below is merely an example, and it goes without saying that the present invention is not limited to the self-checkout device described below. In the following description, a right-and-left direction defined when the self-checkout device is seen from a front may be referred to as "width direction", and a front-and-rear direction may be referred to as "depth direction". In FIG. 1 (*a*), the width direction and the depth direction are indicated by arrows W and D, respectively.

The self-checkout device according to the embodiment of the present invention is a device to be used as follows. Specifically, a clerk uses a POS terminal device (not shown) to perform product registration of a product which is to be purchased by a customer, and the customer uses the self-checkout device to perform checkout after completion of the product registration. The self-checkout device includes a control unit (not shown) and a communication unit (not shown), and performs wired communication with the POS terminal device to receive product registration data registered by the clerk from the POS terminal device. The self-checkout device may perform wireless communication with the POS terminal device.

The self-checkout device includes, in its housing, a change device, a code reader, a card reader, a receipt printer, and a human-presence sensor. The change device is configured to separately receive banknotes and coins and pay out change as needed. The code reader is configured to read, for example, a barcode or a two-dimensional code of a membership card. The card reader is configured to read data of, for example, a credit card. The receipt printer is configured to print and discharge a receipt. The human-presence sensor is configured to detect a human. With regard to the membership card, for example, a magnetic card reader or an IC card reader besides the code reader may be provided in accordance to a type of the membership card.

With reference to FIG. 1 (*a*) and FIG. 1 (*b*), an appearance of a self-checkout device 100 is described. A display 120 with a touch panel is provided on an upper portion of a housing 110 of the self-checkout device 100, and a patrol lamp (warning lamp) 125 is provided on a top surface of the housing 110. Further, a bar code reader placement unit 130 is provided on a left side surface of the housing 110, and a bar code reader 135 of a handy type is placed thereon. Still further, a pedestal 115 is provided at a lower portion of the housing 110. Through switching of a mode, the self-checkout device 100 can be used also as a self-POS terminal device which allows a customer to perform operations including product registration and checkout. The bar code reader 135 is used when the self-checkout device 100 is used as a self-POS terminal device. When the self-checkout device 100 is used only as a self-checkout device, the bar code reader 135 and the bar code reader placement unit 130 are not required.

A coin placement unit 200 as a main part of the present invention is provided on the front side of the self-checkout device 100, in addition to a fixed type bar code reading port 140, a speaker sound output hole 145, a card slot 150 for a card such as a credit card, a banknote slot 155, a banknote pay-out port 160, a receipt outlet 165, a human-presence sensor 170, a coin pay-out port 175, a defective coin return port 180. LED lamps 185, which are configured to turn on or blink and turn off depending on a progress of a check-out process in the self-checkout device 100, are provided in the vicinities of the card slot 150, the banknote pay-out port 160, the receipt outlet 165, the coin pay-out port 175, the defective coin return port 180, and the coin placement unit 200, respectively.

Each of the above-mentioned elements other than the coin placement unit 200 to be described later is not associated with the gist of the present invention, and hence detailed description thereof is omitted. Further, a series of checkout operation modes of the self-checkout device 100 are also the same as that of an existing device except parts around the coin placement unit 200, and hence detailed description thereof is omitted.

Figure 4:
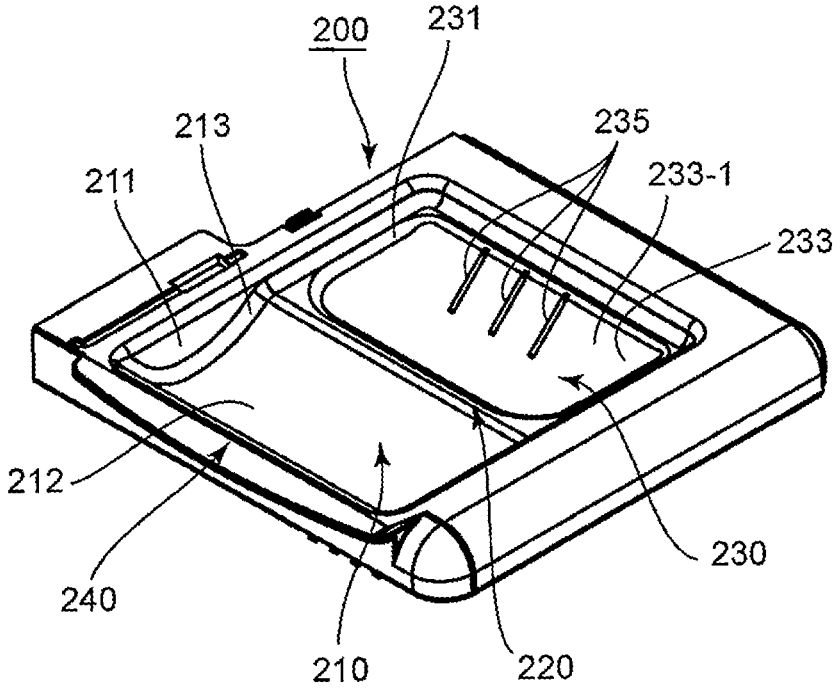
FIG. 4 is a perspective view of the coin placement unit of FIG. 3 (*a*) alone.
Figure 5:
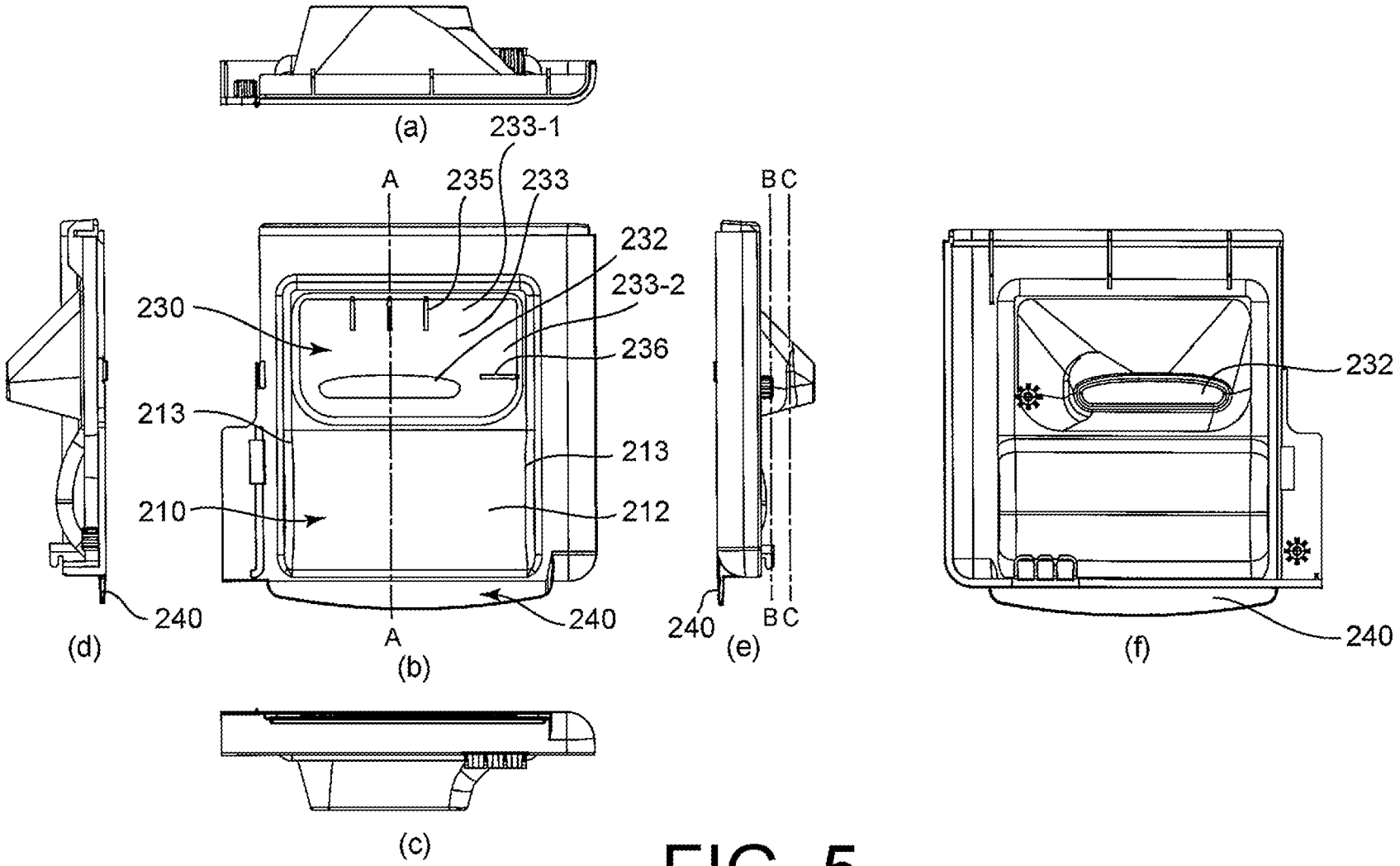
FIG. 5 includes (*a*) to (*f*) which are a rear view (upside down), a top view, a front view, a left side view, a right side view, and a bottom view of the coin placement unit of FIG. 4 alone, respectively.

FIG. 4 is a perspective view of the coin placement unit 200 which may serve as a main part of the self-checkout device 100 according to the present invention. FIG. 5 (*a*) to FIG. 5 (*f*) are a rear view, a top view, a front view, a left side view, a right side view, and a bottom view of the coin placement unit 200 of FIG. 4 alone, respectively. In FIG. 5 (*a*) being a rear view, an up-side-down illustration is given, in which a lower surface side is depicted on an upper side.

Figure 6:
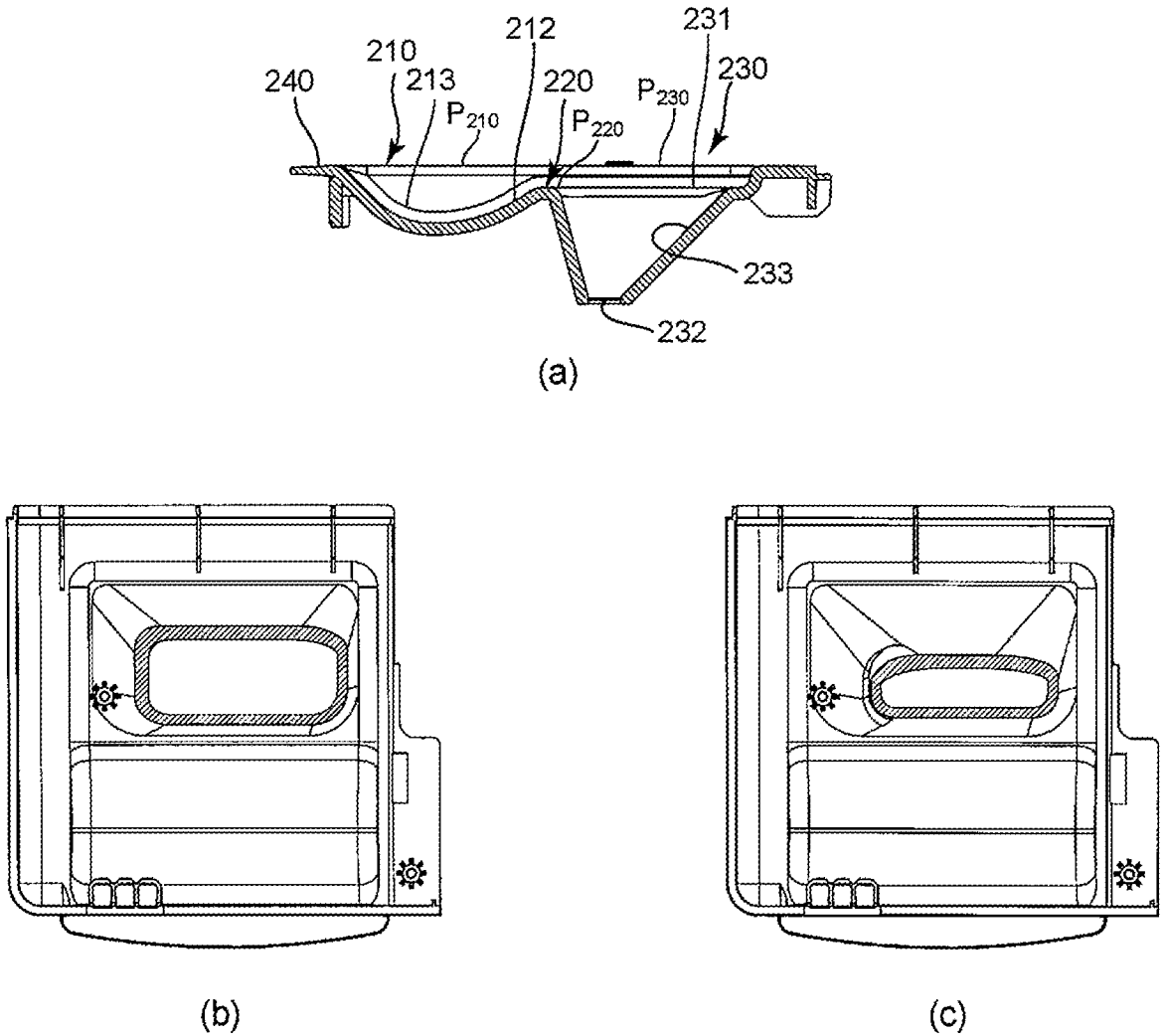
FIG. 6 includes (*a*) which is a longitudinal sectional view of FIG. 5 (*b*) taken along the line A-A and seen from a right side, (*b*) which is a transverse sectional view of FIG. 5 (*e*) taken along the line B-B and seen from below, and (*c*) which is a transverse sectional view of FIG. 5 (*e*) taken along the line C-C and seen from below.

FIG. 6 (*a*) is a longitudinal sectional view of FIG. 5 (*b*) taken along the line A-A and seen from the right side. FIG. 6 (*b*) is a transverse sectional view of FIG. 5 (*e*) taken along the line B-B and seen from below. FIG. 6 (*c*) is a transverse sectional view of FIG. 5 (*e*) taken along the line C-C and seen from below.

Figure 7:
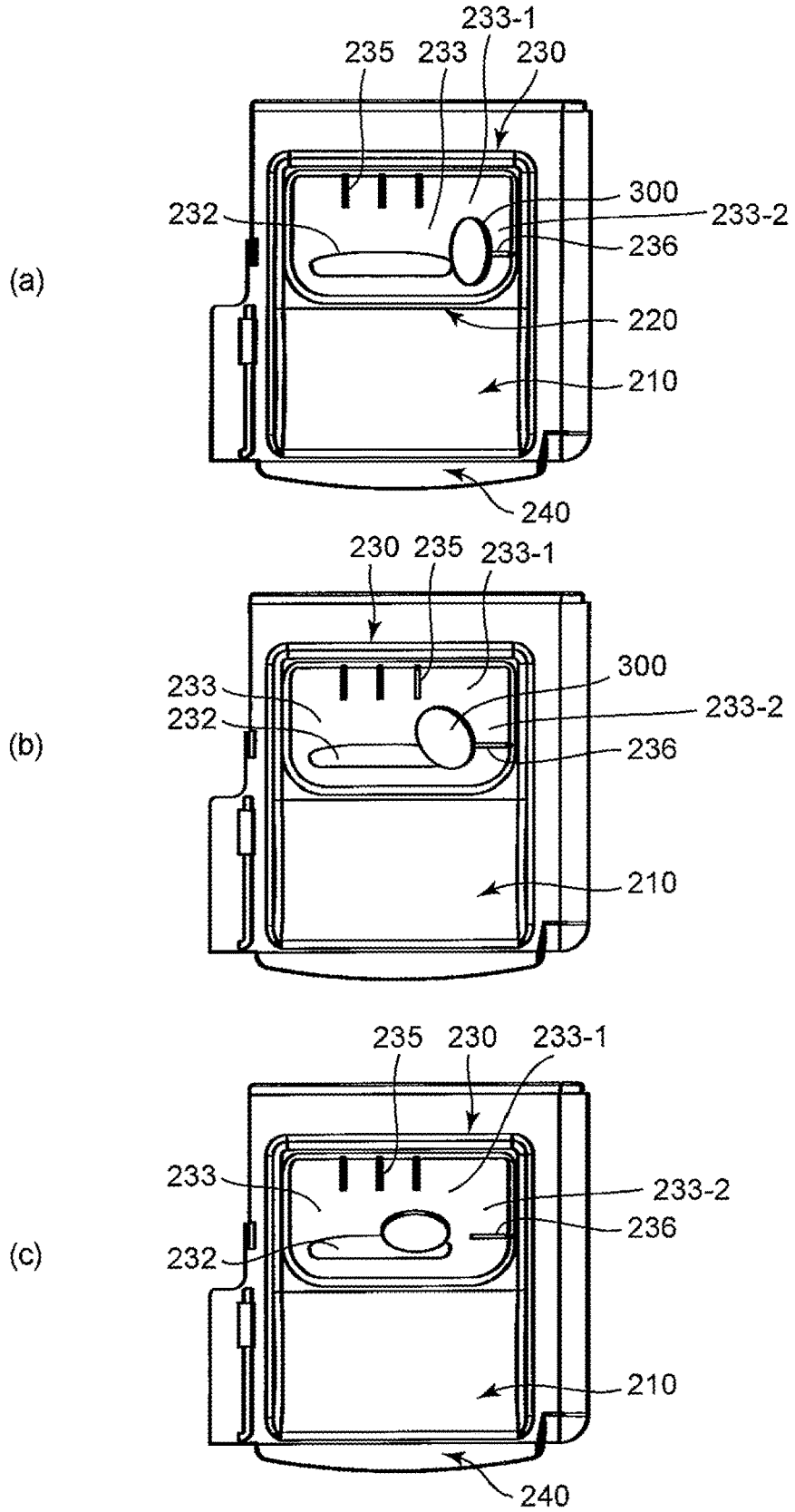
FIG. 7 includes (*a*), (*b*), and (*c*) which are views for illustrating a state in which a coin introduced into a coin slot portion of FIG. 4 is guided into a coin slot.

FIG. 7 (*a*), FIG. 7 (*b*), and FIG. 7 (*c*) are views for illustrating a state in which a coin introduced into a coin slot portion of the coin placement unit 200 is guided into a coin slot.

With reference to FIG. 4, the coin placement unit 200 includes a coin spread portion 210, a ridge line portion 220, a coin slot portion 230, and an extension portion 240. As can be understood from FIG. 6 (*a*), the extension portion 240 is continuous to an end portion of the coin spread portion 210 on a front side without a step serving as a boundary, and extends in a direction of separating from the coin spread portion 210 (in the embodiment, the direction toward a side opposite to a depth side, that is, forward). The extension portion 240 has, in particular, a plate shape, and has a shape of a curved line in which an extension length of a front end thereof is, when seen from the front, shortened as being away from a center thereof. The reason for employing such configuration is described later.

The coin spread portion 210 includes two perpendicular wall surfaces 211 and a recessed surface 212. The two perpendicular wall surfaces 211 are formed on both sides of the coin spread portion 210 in the width direction and face each other. The recessed surface 212 is formed between the two wall surfaces 211, and is formed of a shallow gutter-shaped recessed portion extending in a direction orthogonal to the wall surfaces 211, that is, in the width direction. A boundary between each of the wall surfaces 211 and the recessed portion 212 do not form a crossing angle of 90 degrees, but form rounded curved surfaces 213. The intended use of the recessed surface 212 and the curved surfaces 213 is described later. Briefly, the recessed surface 212 and the curved surfaces 213 are used to facilitate an action of taking out coins on the recessed portion 212. It is desired that the recessed portion 212 have a space for allowing ten or more coins to be placed thereon, and has a curvature which allows a gap to be formed between the recessed portion 212 and the coins placed thereon.

The ridge line portion 220 is formed across an entire width in the width direction between the coin spread portion 210 and the coin slot portion 230, and partitions the coin spread portion 210 and the coin slot portion 230. In particular, as can be understood from FIG. 6 (*a*), a highest point $P_{210}$ of an upper end portion of the coin spread portion 210 and a highest point $P_{230}$ of an upper end portion of the coin slot portion 230 are continuous, and a height of the highest point $P_{210}$ of the upper end portion of the coin spread portion 210 and a height of the highest point $P_{230}$ of the upper end portion of the coin slot portion 230 are equal. Further, a height of a highest point $P_{220}$ of the ridge line portion 220, which is continuous to an end portion on the depth side of the recessed surface 212 of the coin spread portion 210, is lower than the height of the highest point $P_{210}$ of the upper end portion of the coin spread portion 210 and the height of the highest point $P_{230}$ of the upper end portion of the coin slot portion 230.

The coin slot portion 230 includes a coin slot portion inlet 231, a coin slot 232 (FIG. 3 (*a*) and FIG. 6 (*a*)), and an inclined surface 233. The coin slot portion inlet 231 is formed on top of the coin slot portion 230 and has a substantially rectangular shape. The coin slot 232 is formed at a lower end portion of the coin slot portion 230. The inclined surface 233 is continuous from the coin slot portion inlet 231 having a substantially rectangular shape to the coin slot 232. In detail, as can be understood from FIG. 5 (*b*) and FIG. 6 (*a*), the coin slot 232 is formed on one side (left side in this case) with respect to the center in the width direction, and on the ridge line portion 220 side (front) in a direction orthogonal to the width direction (depth direction or front-and-rear direction). However, the coin slot 232 may be provided at the center or on the right side with respect to the center in the width direction. The coin slot 232 has a substantially elliptical shape, and has a shape formed of curved lines each having a substantially semicircular shape, which are formed on both sides and face each other, and curved lines being two line segments extending between the two curved lines each having a substantially semicircular shape. A central portion of at least one of the two line segments (in this embodiment, the line segment on the depth side) protrudes outward (depth side). As a matter of course, central portions of both of the two line segments described above may have shapes to protrude outward (depth side and front side). Further, sizes of the coin slot 232 in the width direction and in the depth direction (front-and-rear direction) are set to have values sufficiently larger than a diameter and a thickness of the largest coin (500 yen coin in Japan), respectively.

The inclined surface 233 has four surfaces extending from the coin slot portion inlet 231 having a substantially rectangular shape to the coin slot 232. Those surfaces are inclined from the coin slot portion inlet 231 having a substantially rectangular shape to the coin slot 232 so as to allow coins introduced from the coin slot portion inlet 231 to fall into the coin slot 232. In particular, a surface which forms a depth side in the depth direction among the four surfaces is an inclined surface 233-1 having the smallest inclination angle (angle of the inclined surface with respect to a horizontal plane). Further, one (in this case, right side) of two surfaces facing each other having the inclined surface 233-1 therebetween is an inclined surface 233-2 having an inclination angle larger than that of the inclined surface 233-1. Remaining two surfaces are inclined surfaces each having an inclination angle larger than that of the inclined surface 233-2. Still further, three ribs 235 are provided on a slightly left side on the inclined surface 233-1, and one rib 236 is provided on the inclined surface 233-2. Those ribs 235 and 236 are provided along inclination of the upper portion of the inclined surface. Thus, friction between the coins and the inclined surface is reduced on the upper portion of the inclined surface, thereby allowing the coins to easily slide downward.

For convenience, the inclined surface 233 is divided into four surfaces, and the two out of the four inclined surfaces are denoted by reference symbols for description. However, as illustrated in FIG. 6 (*a*) being the longitudinal sectional view taken along the line A-A of FIG. 5 (*b*), FIG. 6 (*b*) being the transverse sectional view taken along the line B-B of FIG. 5 (*e*), and FIG. 6 (*c*) being the transverse sectional view taken along the line C-C of FIG. 5 (*e*), except the ribs 235 and 236 described above, those inclined surfaces are continuous curved surfaces without a step or a boundary in the vertical direction and in the planar direction, that is, so-called "funnel-shaped curved surfaces". Further, as illustrated in FIG. 6 (*b*) and FIG. 6 (*c*), a cross section of the inclined surface 233 is close to a plane shape of the coin slot 232 as approaching the coin slot 232. The inclined surface 233 of the coin slot portion 230 has the shape described above. Thus, for example, a coin 300 introduced in a posture of being perpendicular to the right side of the coin slot 232 as illustrated in FIG. 7 (*a*) slides down the inclined surface 233-2 having the rounded shape at the upper portion of the curved line having a substantially semicircular shape as illustrated in FIG. 7 (*b*) to be brought into a state of being substantially in parallel to the coin slot 232 as illustrated in FIG. 7 (*c*), and then falls into the coin slot 232. In FIG. 7, a coin having a size of 100 yen coin is illustrated.

As described above, even when the coin 300 is introduced in a posture of being perpendicular to the right side of the coin slot 232 of the coin slot portion 230, the coin 300 does not stay at the coin slot portion 230. The same applies to a coin introduced in a posture of being perpendicular to the left side of the coin slot 232.

In a state in which the coin placement unit 200 is provided to the self-checkout device 100, the coin slot 232 is located on an upper portion of a coin reception port (not shown) of the built-in change device, and a coin having passed through the coin slot 232 is taken into the change device. Lateral widths of the extension portion 240, the coin spread portion 210, and the coin slot portion 230 of the coin placement unit 200 are set to sufficient sizes for accommodating a standard back of hand of a Japanese adult male.

Next, description is made of a customer's action of spreading coins in a wallet on the coin spread portion 210 of the self-checkout device 100, introducing all of desired coins, and thereafter taking out remaining coins from the coin spread portion 210 and returning the remaining coins into the wallet.

1) A customer takes out coins more than necessary from the wallet, and spreads the coins on the coin spread portion 210 of the coin placement unit 200.

2) The customer allows the desired coins on the coin spread portion 210 to slide on the gutter-shaped recessed surface 212 and the ridge line portion 220 of the coin spread portion 210 to introduce the coins to the coin slot portion 230. As is apparent from FIG. 6 (*a*), the ridge line portion 220 is continuous to the end portion on the depth side of the recessed surface 212 of the coin spread portion 210 and the end portion on the front side of the coin slot portion inlet 231 of the coin slot portion 230 without a step serving as a boundary, and hence the action described above can be easily performed. As described above, the height of the highest point $P_{220}$ of the ridge line portion 220, which is continuous to the end portion on the depth side of the recessed surface 212 of the coin spread portion 210, is lower than the height of the highest point $P_{210}$ of the upper end portion of the coin spread portion 210 and the height of the highest point $P_{230}$ of the upper end portion of the coin slot portion 230. Therefore, there is no fear in that the coins flow out from the coin placement unit 200 when the coins are moved from the coin spread portion 210 to the coin slot portion inlet 231. The coins having been introduced into the coin slot portion inlet 231 slide down on the inclined surface and fall into the coin slot 232. The coins having passed through the coin inlet 232 are taken into the change device (not shown).

3) The customer moves aside the remaining coins on the coin spread portion 210 toward the left side (or right side) wall 211 using a plurality of fingers of one hand, and pulls up the coins while grasping the coins along the left side (or right side) wall 211 and recessed surface 212, to thereby take out the coins.

Alternatively, the customer moves the coins toward the center of the coin spread portion 210 using the fingers of one hand, and pulls up the coins while grasping the coins along the recessed surface 212 of the coin spread portion 210 using the plurality of fingers of one hand, to thereby take out the coins. At that time, a gap is formed between the recessed surface 212 and the coins so that the coins can be easily picked up by fingers.

Further, alternatively, the customer turns a palm of one hand upward and puts fingers under the extension portion 240 such that the coins beyond the extension portion 240 are prevented from flowing out from the hand. The customer allows the coins to slide along the recessed surface 212 of the coin spread portion 210 using fingers of another hand, and places the coins on the palm of the one hand via the extension portion 240. Such action can be easily performed with the configuration in which the extension portion 240 is continuous to the end portion on the front side of the recessed surface 212 of the coin spread portion 210 without a step serving as a boundary. Then, such an operation is usually carried out around the center of the extension portion 240. That is the reason why the extension length of a portion close to the center of the extension portion 240 is set larger. Further, the extension portion 240 is rounded at the both ends thereof, and has a shape in which the extension length of the portion close to the center is larger, that is, a large rounded shape, which is also a shape less liable to cause interference with the actions using the fingers of the customer.

4) Then, the coins are returned into the wallet.

The coin placement unit of the self-checkout device according to the present invention has the configuration described above. Therefore, a customer can easily introduce the desired coins into the coin slot 232 and take out the remaining coins to return the coins into the wallet.

The extension portion 240 may be omitted in some cases.

In the embodiment described above, description is made of the self-checkout device to be used in the following manner. That is, a clerk uses the POS terminal device to perform product registration of a product which is to be purchased by a customer, and a customer performs checkout after completion of the product registration. However, as described above with reference to FIG. 1, the self-checkout device may be a self-POS terminal device which allows a customer to perform operations including product registration and checkout.

INDUSTRIAL APPLICABILITY

The coin placement unit according to the present invention can be applied also to cash processing machines in general, that is, cash processing machines (for example, change devices and vending machines) other than the self-checkout device or the self-POS terminal device as described above.

REFERENCE SIGNS LIST

100 self-checkout device
110 housing
115 pedestal
120 display with touch panel
125 patrol lamp
130 bar code reader placement unit
135 bar code reader
140 bar code reading port
145 speaker sound output hole
150 card slot
155 banknote slot
160 banknote pay-out port
165 receipt outlet
170 human-presence sensor
175 coin pay-out port
180 defective coin return port
185 LED lamp
200 coin placement unit
210 coin spread portion
211 wall surface
212 recessed surface
213 curved surface
220 ridge line portion
230 coin slot portion
231 coin slot portion inlet
232 coin slot
233 inclined surface

The invention claimed is:

1. A coin placement unit for a cash processing machine, comprising:

a coin spread portion including:

two perpendicular wall surfaces; and a recessed surface, which is formed between the two perpendicular wall surfaces, and is formed of a gutter-shaped recessed portion extending in a direction orthogonal to the perpendicular wall surfaces;

a coin slot portion including a coin slot; and a ridge line portion formed between the coin spread portion and the coin slot portion so as to partition the coin spread portion and the coin slot portion, wherein the coin spread portion, the ridge line portion, and the coin slot portion have the same width and are continuous in a direction toward a depth side, and wherein the coin placement unit further comprises an extension portion of a plate shape which is formed at an end portion of the coin spread portion, that is not on a side continuous to the ridge line portion, and which extends in a direction of separating from the coin spread portion toward a side opposite to the depth side without a step.

2. The coin placement unit according to claim 1, wherein a highest point of an upper end portion of the coin spread portion and a highest point of an upper end portion of the coin slot portion are continuous, wherein a height of the highest point of the upper end portion of the coin spread portion and a height of the highest point of the upper end portion of the coin slot portion are equal, and wherein a height of the ridge line portion continuous to the recessed surface of the coin spread portion is lower than the height of the highest point of the upper end portion of the coin spread portion and the height of the highest point of the upper end portion of the coin slot portion.

3. The coin placement unit according to claim 1, wherein the extension portion has a shape of a curved line in which an extension length of a front end thereof is, when seen from a front, shortened as being away from a center.

4. The coin placement unit according to claim 1, wherein the coin slot portion includes:

a coin slot portion inlet, which is formed at an upper end portion of the coin slot portion, and has a substantially rectangular shape;

a coin slot, which is formed at a lower end portion of the coin slot portion, and is smaller than the coin slot portion inlet; and an inclined surface, which is continuous from the coin slot portion inlet to the coin slot.

5. The coin placement unit according to claim 4, wherein a surface forming a depth portion in a depth direction in the inclined surface has an inclination angle smaller than an inclination angle of a surface forming another portion of the inclined surface, and at least one rib is formed along inclination of an upper portion of the surface.

6. The coin placement unit according to claim 1, wherein a boundary between each of the perpendicular wall surfaces and the recessed surface forming the recessed portion formed a rounded curved surface.

7. The coin placement unit according to claim 1, wherein the coin slot has a substantially elliptical shape, and has a shape formed of curved lines each having a substantially semicircular shape, which are formed on both sides and face each other, and curved lines each having a substantially semicircular shape, and a central portion of at least one of two line segments protrudes outward.

8. A self-checkout device, comprising the coin placement unit of claim 1.

* * * * *